US012560050B1

(12) United States Patent
Vellingiri et al.

(10) Patent No.: US 12,560,050 B1
(45) Date of Patent: Feb. 24, 2026

(54) VALVE SYSTEM WITH CONTINGENCY OVERRIDE

(71) Applicant: OneSubsea IP UK Limited, London (GB)

(72) Inventors: Samuvel Vellingiri, Houston, TX (US); Jose Braz, Houston, TX (US); Hebert Dacorregio Heidenreich, Rio de Janeiro (BR); David Gwyn, Houston, TX (US); Gustavo Gonzalez, Houston, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 18/928,432

(22) Filed: Oct. 28, 2024

(51) Int. Cl.
*E21B 34/02* (2006.01)

(52) U.S. Cl.
CPC ..... *E21B 34/02* (2013.01)

(58) Field of Classification Search
CPC ..... F16K 3/0254; E21B 34/02; E21B 34/025; E21B 34/04; E21B 34/045; E21B 34/00
See application file for complete search history.

(56) References Cited

U.S. PATENT DOCUMENTS 4,921,207 A * 5/1990 Baker ..... F16K 3/0254 74/25
5,081,909 A * 1/1992 Hart ..... F16K 31/1221 92/60
5,497,672 A * 3/1996 Appleford ..... E21B 34/04 251/71
6,352,239 B1 * 3/2002 McIntosh ..... F15B 15/1457 251/64
10,690,001 B2 * 6/2020 Nishiyama ..... F01D 21/16
2010/0171058 A1 * 7/2010 Jennings ..... F16K 31/52408 251/251
2018/0106127 A1 * 4/2018 Du ..... E21B 33/1285
2018/0245711 A1 * 8/2018 Oak ..... F16K 31/508
2020/0158251 A1 * 5/2020 Vanryckeghem ..... E21B 34/02
2021/0363857 A1 * 11/2021 Tandberg ..... F16K 3/0254
2024/0254858 A1 * 8/2024 Rokne ..... E21B 34/04

FOREIGN PATENT DOCUMENTS

WO 2019141595 A1 7/2019
WO 2022002981 A1 1/2022

* cited by examiner

*Primary Examiner* — Kipp C Wallace
(74) *Attorney, Agent, or Firm* — Kyle R. Miiller

(57) ABSTRACT

A wellhead module, comprising: a housing, a valve member, an actuator assembly, and a locking mechanism. The valve member extends through an opening at an end of the housing and is translatable between an open position and a closed position. The actuator assembly is disposed within the housing and is configured to translate the valve member between the open position and the closed position. The locking mechanism is convertible from a first state to a second state, the actuator assembly is axially locked to the housing at a first axial position in the first state, and the actuator assembly is unlocked from the housing in a second state and thus movable to a second axial position within the housing.

15 Claims, 7 Drawing Sheets

VALVE SYSTEM WITH CONTINGENCY OVERRIDE

BACKGROUND

Field

The present disclosure generally relates to valve systems with a contingency override.

Description of the Related Art

Wellhead systems are used to control fluid flow into and out of wellbores during wellbore operations. The wellhead systems include a tree including one or more valves for controlling fluid flow into and out of wellbores. These valves can be located on trees subsea or may otherwise be difficult or impractical to remove and replace. Occasionally, one or more of the valves may have components that become stuck rendering the valve itself stuck in an open or closed configuration. When this occurs, it is desirable to be able to override the valve to configure the valve in the open or closed configuration. Thus, there is a need in the art for a valve system with a contingency override.

SUMMARY

According to one or more embodiments, a wellhead module, comprising: a housing, a valve member, an actuator assembly, and a locking mechanism. The valve member extends through an opening at an end of the housing and is translatable between an open position and a closed position. The actuator assembly is disposed within the housing and is configured to translate the valve member between the open position and the closed position. The locking mechanism is convertible from a first state to a second state, the actuator assembly is axially locked to the housing at a first axial position in the first state, and the actuator assembly is unlocked from the housing in a second state and thus movable to a second axial position within the housing.

According to one or more embodiments, a wellhead module, comprising: a housing, a valve member, an actuator assembly, at least one locking member, and a piston. The valve member extends through an opening at an end of the housing and is translatable between an open position and a closed position. The actuator assembly is disposed within the housing and is configured to translate the valve member between the open position and the closed position. The at least one locking member is movable from a radially extended position to a radially retracted position, the actuator assembly is axially fixed to the housing at a first axial position when the at least one locking member is in the radially extended position and the actuator assembly is movable to a second axial position relative to the housing when the at least one locking member is in the radially retracted position. The piston is disposed in the housing movable from a first position to a second position, wherein in the first position the piston retains the locking member in the radially extended position, and wherein the at least one locking member is allowed to move to the radially retracted position when the piston is moved to the second position.

According to one or more embodiments, A method for overriding a gate valve, comprising: engaging an override module with a module coupled to a valve member, wherein the module includes a housing and an actuator assembly locked to the housing in a first axial position and connected to the valve member; unlocking the actuator assembly from the housing; and actuating the override module to move the actuator assembly from the first axial position to a second axial position within the housing to move the valve member from a first position to a second position.

The following description and the appended figures set forth certain features for purposes of illustration.

BRIEF DESCRIPTION OF DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The disclosure contemplates that terms such as "couples," "coupling," "couple," and "coupled" may include but are not limited to welding, interference fitting, and/or fastening such as by using bolts, threaded connections, pins, clips, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling, such as indirect coupling through components such as links.

Aspects of the present disclosure provide systems, apparatus, and methods of a wellhead system with an overridable wellhead module and valve that may be opened or closed when one or more components of the valve and/or the wellhead module is stuck. The wellhead system disclosed herein includes a valve, and a wellhead module including an actuator assembly and a locking mechanism. The actuator assembly selectively opens and closes the valve. The locking mechanism selectively couples the actuator assembly to the housing of the wellhead module such that when the valve is stuck in the open or closed position, the actuator assembly can be uncoupled from the housing of the wellhead module to move the valve into the open or closed position. The wellhead system further includes a retrievable module and an override module, both selectively coupled to the wellhead module. The retrievable module is configured to actuate the actuator assembly to open and close the valve. The override module is swappable with the retrievable module and configured to axially translate the actuator assembly when the valve is stuck to open or close the stuck valve.

Figure 1:
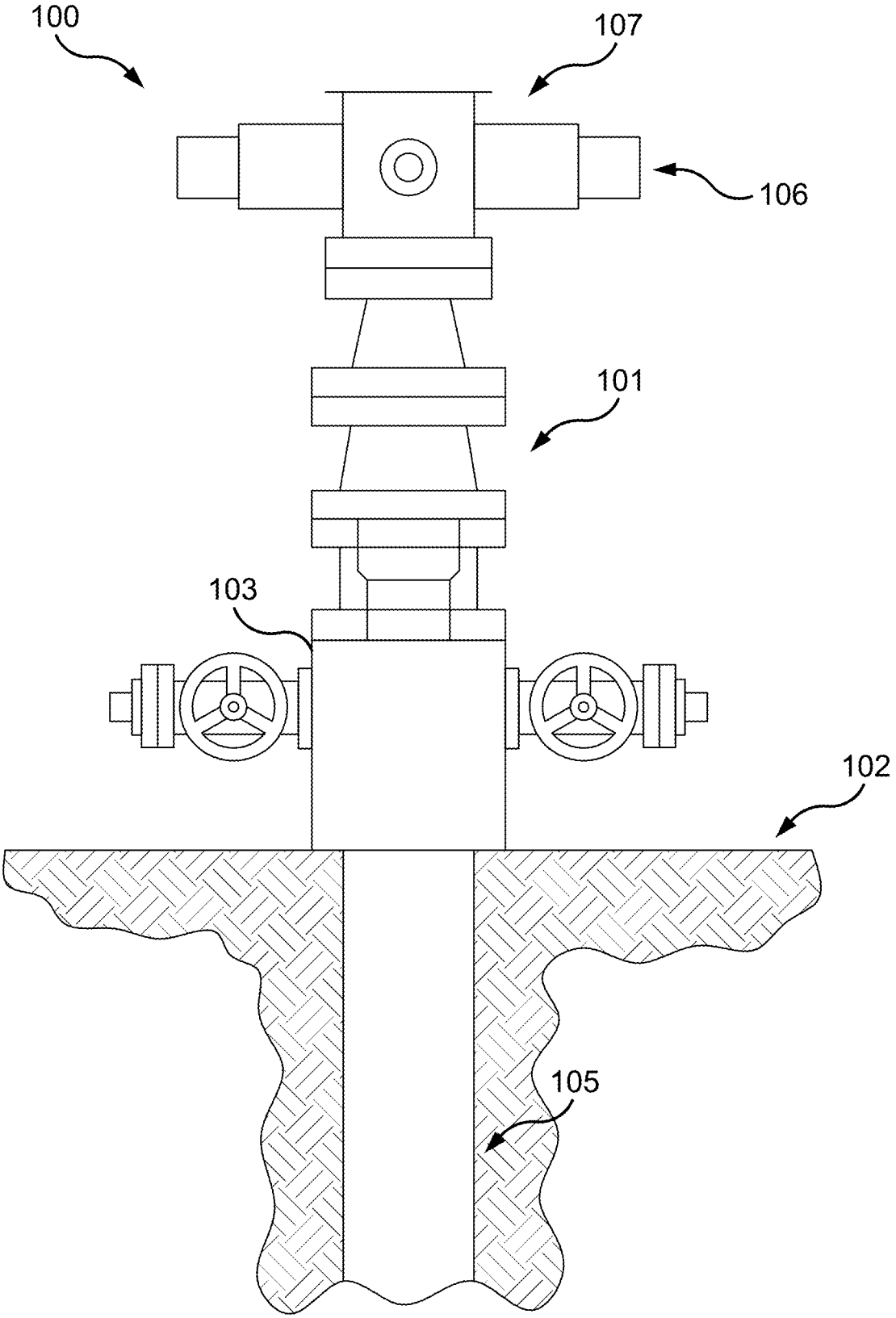
FIG. 1 illustrates an exemplary wellhead system, according to one or more embodiments.

FIG. 1 illustrates an exemplary wellhead system 100. The wellhead system 100 includes a tree 101 disposed on a surface 102 which may be a sea floor in a subsea wellbore operation or may be land in a land-based operation. The tree 101 is coupled to a wellhead 103 which is coupled to a wellbore 105. The wellhead system 100 is used to control the pressure and flow of fluid into and out of the wellbore 105 during wellbore operations.

The wellhead system 100 further includes one or more valves 107. One or more of the valves 107 may be a gate valve and is hereinafter referred to as gate valve 107. Each gate valve 107 is coupled to the tree 101 and is configured to open and close fluid flow through the tree 101. A wellhead module 106 is coupled to the gate valve 107. The wellhead module 106 actuates the gate valve 107 to selectively open and close fluid communication through the tree 101.

Figure 2A:
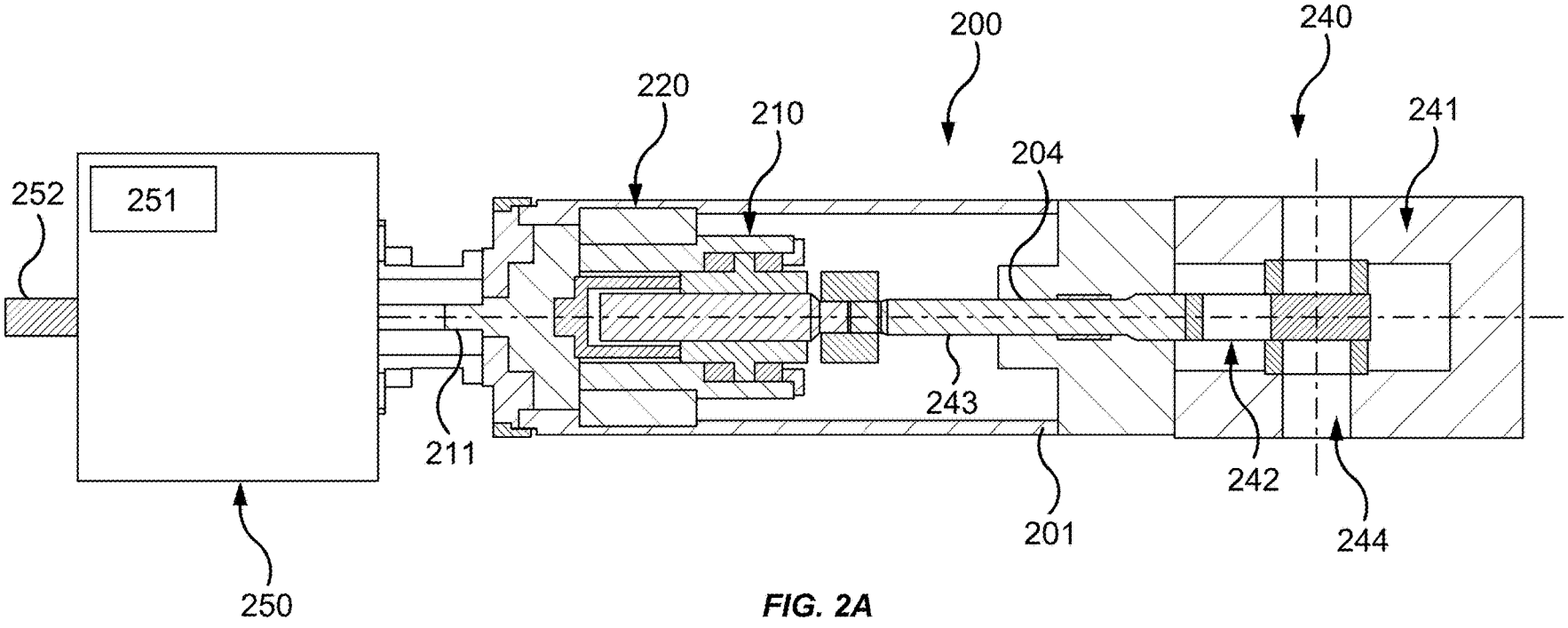
FIG. 2A illustrates a retrievable module, a gate valve, and a wellhead module including a locking mechanism in the locked state, according to one or more embodiments.
Figure 2B:
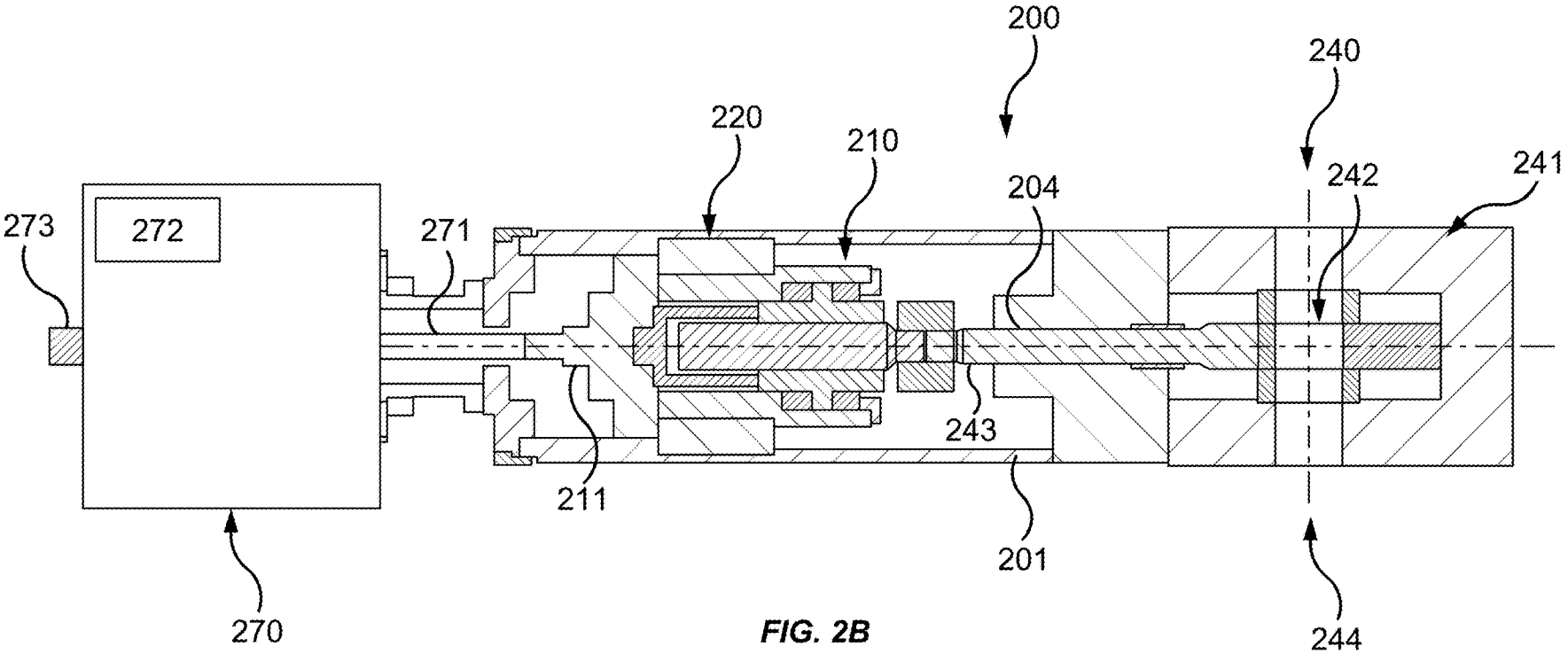
FIG. 2B illustrates an override module, the gate valve, and the wellhead module of FIG. 2A with the locking mechanism in the unlocked state and the actuator assembly axially translated, according to one or more embodiments.

FIGS. 2A-2B illustrate an exemplary wellhead module 200 and gate valve 240 which may be used in place of wellhead module 106 and gate valve 107 of FIG. 1. FIGS. 2A-2B also illustrate a retrievable module 250 (shown in FIG. 2A) and an override module 270 (shown in FIG. 2B) which may be coupled to the wellhead module 200.

The gate valve 240 includes a valve housing 241, a valve member 242, and a valve stem 243. The housing 241 includes a flow path 244 for fluid flow. The valve member 242 is disposed within the valve housing 241 and the valve stem 243 is at least partially disposed within the valve housing 241. The valve member 242 is coupled to, and is translated by the valve stem 243.

The valve member 242 is positionable within the flow path 244 in various positions to open, close, or choke fluid flow through the flow path 244. When the valve member 242 blocks fluid flow through the flow path 244, the valve member 242 is said to be in the closed position (as shown in FIG. 2A). When the valve member 242 permits fluid flow through the flow path 244, the valve member 242 is said to be in the open position (as shown in FIG. 2B).

The wellhead module 200 includes a housing 201, an actuator assembly 210, and a locking mechanism 220. The wellhead module 200 is coupled to the gate valve 240 and is configured to control the position of the valve member 242. The actuator assembly 210 is disposed within the housing 201 and is selectively coupled to the interior of the housing 201 by the locking mechanism 220. The valve stem 243 is coupled to, and is movable by, the actuator assembly 210. The valve stem 243 may be at least partially disposed within the housing 201 and the valve member 242 extends through an opening 204 at the end of the housing 201.

The actuator assembly 210 is configured to translate the valve stem 243, thereby translating the valve member 242 between the open and closed positions, to open, close, or choke fluid flow through the flow path 244. In some embodiments, the actuator assembly 210 is electrically actuated. In some embodiments, the actuator assembly 210 is hydraulically actuated. In some embodiments, the actuator assembly 210 is manually operated. In some embodiments, the actuator assembly 210 includes a piston that translates the valve stem 243. In other embodiments, the actuator assembly 210 receives a rotational input at an input shaft 211, converts the rotational input to a translational output to translate the valve stem 243 and move the valve member 242. In such embodiments, the actuator assembly 210 may include, but is not limited to a roller screw assembly, a ball screw assembly, gearing, and/or any combination thereof.

Figure 3A:
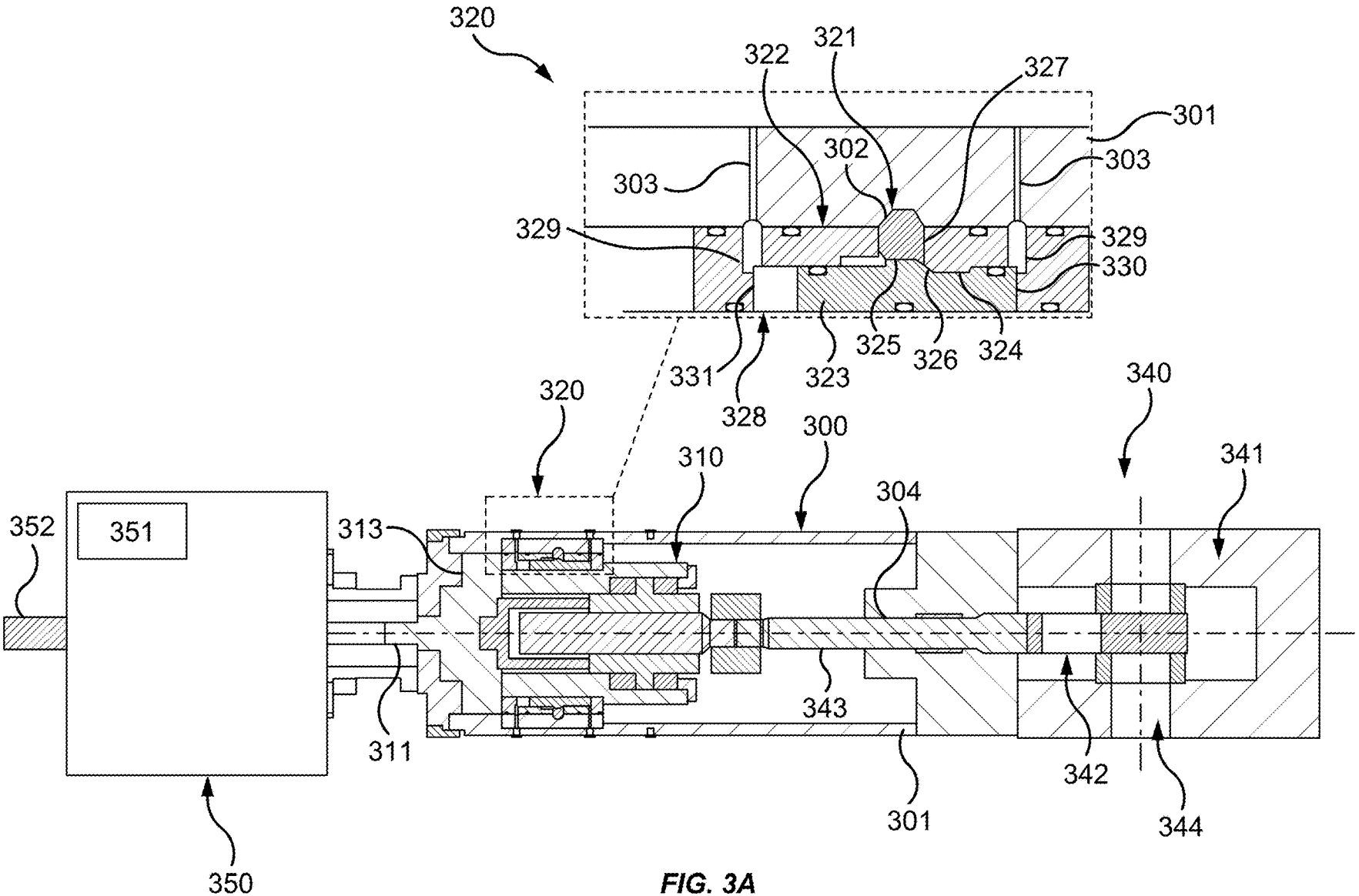
FIG. 3A illustrates a retrievable module, a gate valve, and a wellhead module including another locking mechanism in the locked state, according to one or more embodiments.
Figure 3B:
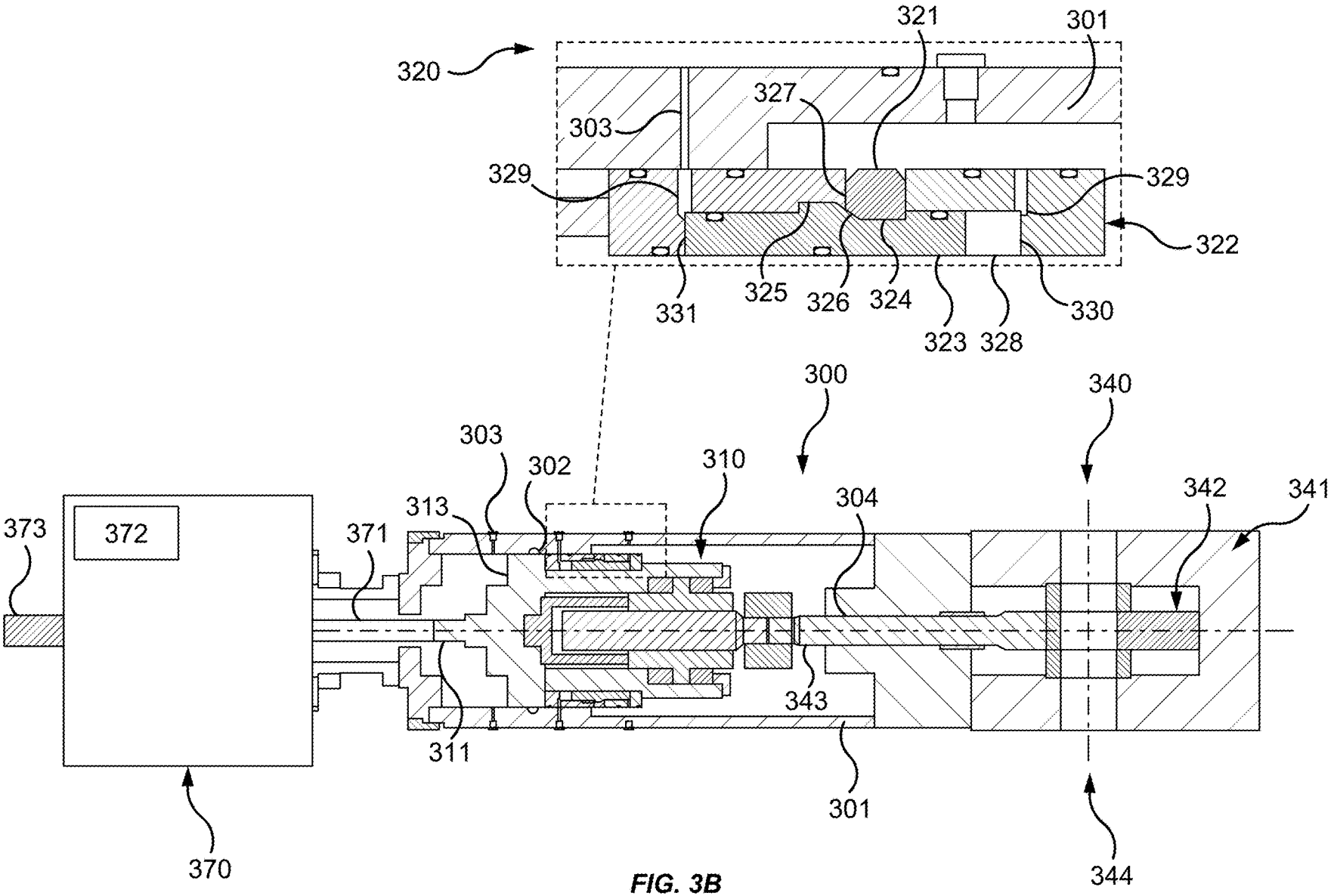
FIG. 3B illustrates an override module, the gate valve, and the wellhead module of FIG. 3A with the locking mechanism in the unlocked state and the actuator assembly axially translated, according to one or more embodiments.
Figure 4A:
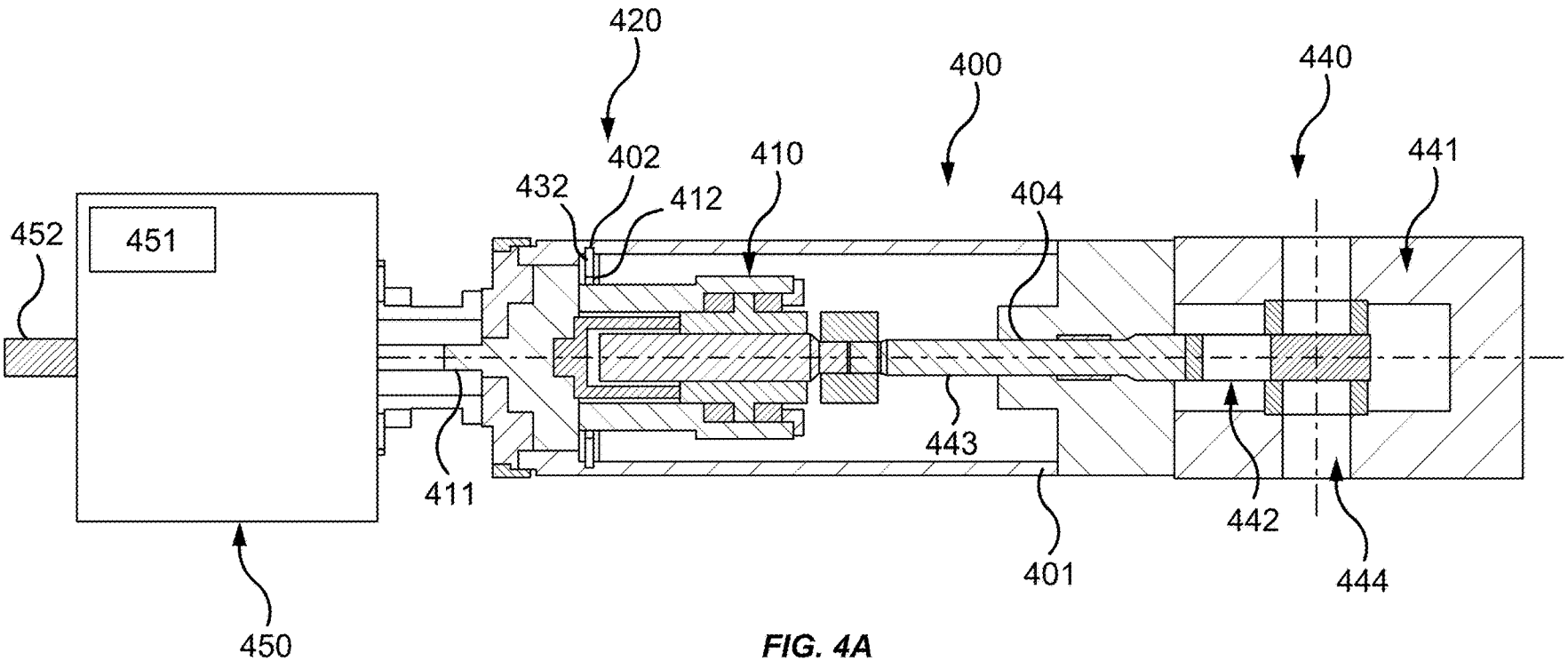
FIG. 4A illustrates a retrievable module, a gate valve, and a wellhead module including another locking mechanism in the locked state, according to one or more embodiments.
Figure 4B:
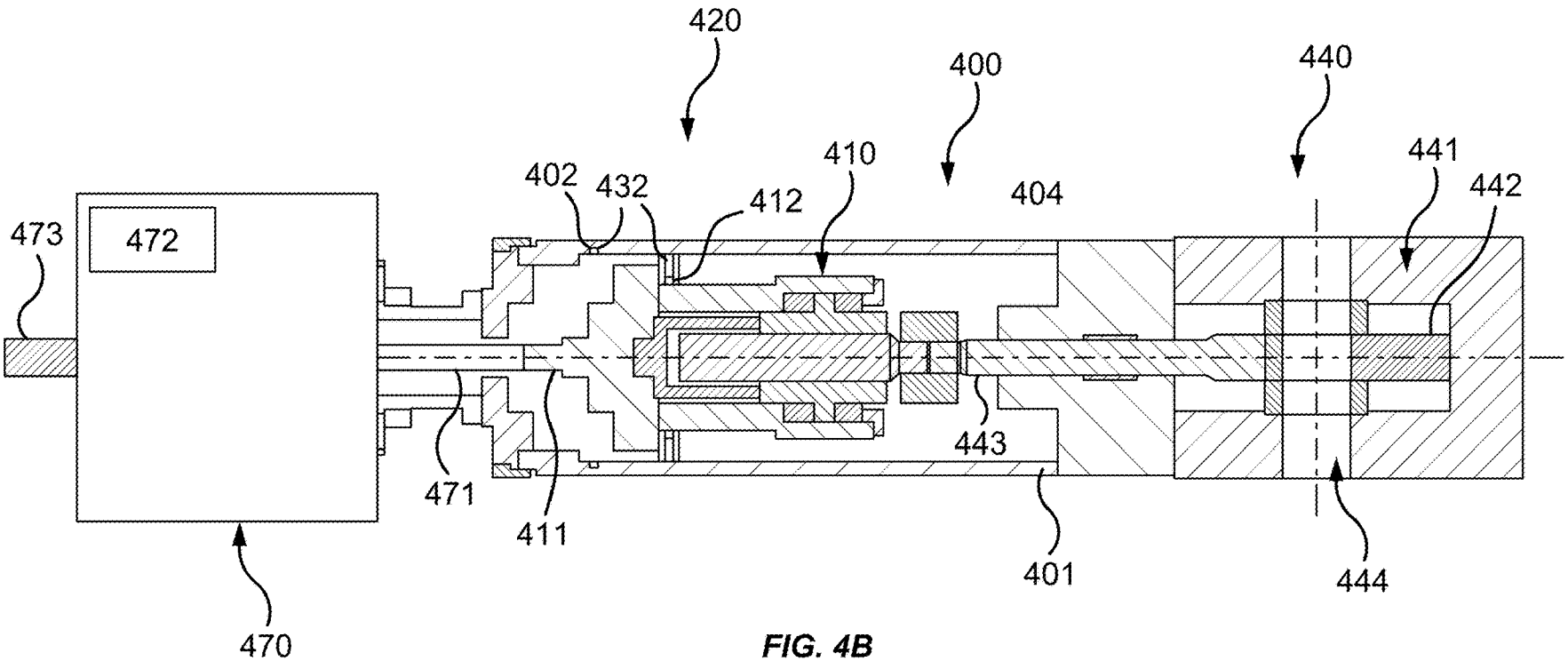
FIG. 4B illustrates an override module, the gate valve, and the wellhead module of FIG. 4A with the locking mechanism in the unlocked state and the actuator assembly axially translated, according to one or more embodiments.

The locking mechanism 220 is configurable in a locked state (as shown in FIGS. 2A, 3A, and 4A) and an unlocked state (as shown in FIGS. 2B, 3B, and 4B). When the locking mechanism 220 is in the locked state, the actuator assembly 210 is axially fixed with respect to the housing 201 of the wellhead module 200. When the locking mechanism 220 is in the unlocked state, the actuator assembly 210 is permitted to move axially within the housing 201 of the wellhead module 200. During normal operation, such as when the actuator assembly 210 is able to translate the valve member 242 between the open and closed positions, the locking mechanism 220 is in the locked state. When normal operation is prevented, such as when one or more components of the actuator assembly 210 or the valve stem 243 are stuck such that the actuator assembly 210 is unable to translate the valve member 242, the locking mechanism 220 is configurable into the unlocked state so that the actuator assembly 210, valve stem 243, and valve member 242 may be translated to override the gate valve 240.

The locking mechanism 220 illustrated in FIGS. 2A-2B is an exemplary locking mechanism 220. Additional embodiments of the locking mechanism 220 are described below.

FIG. 2A illustrates the retrievable module 250 coupled to the housing 201 of the wellhead module 200 and the gate valve 240 with the locking mechanism 220 in the locked state.

The retrievable module 250 is removably coupled to the wellhead module 200 and is configured to actuate the actuator assembly 210 to translate the valve stem 243 to move the valve member 242 and open, close, or choke flow through the flow path 244.

The retrievable module 250 is removable from the wellhead module 200 so that it may be retrieved and replaced by other components, such as the override module 270 described below.

In some embodiments, the retrievable module 250 may include an electrical motor that imparts a rotational input on the input shaft 211. The retrievable module 250 may also include a controller 251. The controller 251 is configured to receive and transmit signals and/or instructions via a cable 252 to and from a site remote to the wellhead system 100. In some embodiments, the retrievable module 250 may include a battery or other electrical component configured to supply electricity to the actuator assembly 210.

In embodiments wherein the actuator assembly 210 is configured to convert a rotational input to a translational output, the retrievable module 250 imparts rotational motion onto the input shaft 211 of the actuator assembly 210 which translates the valve stem 243 to move the valve member 242 and open, close, or choke flow through the flow path 244. In embodiments wherein the actuator assembly 210 is a linear actuator, the retrievable module 250 provides power to the actuator assembly 210 to translate the valve stem 243.

In embodiments wherein the actuator assembly 210 is hydraulically operated, the retrievable module 250 may supply hydraulic fluid to actuate the actuator assembly 210.

Still, in other embodiments the retrievable module 250 may be manually operated to actuate the actuator assembly 210.

FIG. 2B illustrates the override module 270 coupled to the housing 201 of the wellhead module 200 and the gate valve 240 with the locking mechanism 220 in the unlocked state and the actuator assembly 210 axially translated.

Occasionally, one or more components of the wellhead module 200, such as one or more components of the actuator assembly 210 or the valve stem 243, may become stuck thus causing the valve stem 243 to be axially fixed with respect to the actuator assembly 210. In such instances, the valve member 242 may be stuck in the open position or the closed position. When the valve stem 243 is axially fixed with respect to the actuator assembly 210 such that the valve member 242 is stuck, it is important for operators of the wellhead system 100 to be able to override the wellhead module 200 and gate valve 240 to open or close fluid flow through the flow path 244.

Therefore, when the valve member 242 is stuck, the retrievable module 250 of FIG. 2A is swappable with the override module 270 of FIG. 2B. In some embodiments, the retrievable modules described and illustrated herein and the override modules described and illustrated herein are deployed, retrieved, installed, and uninstalled by a wireline and a remotely operated vehicle (ROV). For instance, the retrievable module may be uninstalled by a ROV and retrieved by a wireline and the override module may be deployed by a wireline and installed by a ROV. The override module 270 is removably coupled to the wellhead module 200 and is configured to translate the actuator assembly 210, valve stem 243, and valve member 242 to move the valve member 242 to the open or closed position. The override module 270 engages with and translates the actuator assembly 210 by applying an axial force onto the actuator assembly 210. In some embodiments, the override module 270 includes a piston 271 that exerts the axial force onto the actuator assembly 210 (such as on the input shaft 211) to translate the actuator assembly 210. In some embodiments, the override module 270 includes a controller 272 configured to receive and transmit signals and/or instructions via a cable 273 to and from a site remote to the wellhead system 100 such as the surface facility in a subsea operation. In some embodiments, the override module 270 is manually operated to translate the actuator assembly 210.

When the valve member 242 is stuck, the locking mechanism 220 is configured from the locked state (as shown in FIG. 2A) to the unlocked state (as shown in FIG. 2B), thereby allowing the actuator assembly 210, valve stem 243, and valve member 242 to axially move within the housing 201 of the wellhead module and the housing 241 of the gate valve 240.

With the locking mechanism 220 in the unlocked state, the override module 270 applies an axial force onto the actuator assembly 210 to translate the actuator assembly 210, valve stem 243, and valve member 242 with respect to the housing 201 of the wellhead module 200 and the housing 241 of the gate valve 240 to move the valve member 242 into the open or closed position.

FIGS. 3A-3B illustrate another exemplary wellhead module 300 and gate valve 340 which may be used in place of wellhead module 106 and gate valve 107 of FIG. 1. Similar to the embodiment shown in FIGS. 2A-2B, the wellhead module 300 includes a housing 301, an actuator assembly 310, and a locking mechanism 320. For the sake of brevity, all similar components have been given reference numbers with the same last two digits, and a full description of such similar components may not be repeated herein.

The housing 301 includes a recess 302 and one or more hydraulic fluid ports 303. The recess 302 may be a groove and/or one or more discrete recesses within the inner surface of the housing 301.

The locking mechanism 320 is disposed between the actuator assembly 310 and the inner surface of the housing 301 of the wellhead module 300. The locking mechanism 320 is coupled to the actuator assembly 310 and is selectively coupled to the housing 301 of the wellhead module 300. In some embodiments, the locking mechanism 320 is coupled to the actuator assembly 310 by a backing plate 313 coupled to the actuator assembly. In the locked state (as shown in FIG. 3A), the locking mechanism 320 is coupled to the housing 301 of the wellhead module 300 thereby axially fixing the actuator assembly 310 within the housing 301. In the unlocked state (as shown in FIG. 3B), the locking mechanism 320 is uncoupled from the housing 301 of the wellhead module 300 thereby allowing the actuator assembly 310 to move axially within the housing 301. The locking mechanism 320 includes a locking member 321, a retention sleeve 322, and a piston 323. In some embodiments, the locking member 321 is a snap ring and the recess 302 is a groove. In some embodiments, the locking member 321 is one or more pins and the recess 302 is one or more corresponding holes. In other embodiments, the locking member 321 is a dog and the recess 302 is shaped to receive the dog wherein in the locked state, the dog is radially extended into the recess 302 and in the locked state the dog is radially retracted out of the recess 302.

The piston 323 includes a first outer surface 324, a second outer surface 325 radially outward from the first outer surface 324, and a taper 326 therebetween.

The retaining sleeve 322 includes a locking member recess 327, a piston recess 328, and one or more hydraulic fluid ports 329 allowing fluid communication from the outer surface of the retaining sleeve 322 to the piston recess 328. In the illustrated embodiment, there are two hydraulic fluid ports 329 coupled to either end 330, 331 of the piston recess 328. However, in some embodiments, there may be one hydraulic fluid port 329 coupled to one of the ends 330, 331 of the piston recess 328.

The locking member recess 327 retains the locking member axially with respect to the retaining sleeve 322 and the piston 323. The piston recess 328 retains the piston 323. The piston recess 328 is larger than the length of the piston 323 to allow the piston 323 to move axially with respect to the retaining sleeve 322.

The piston 323 is movable within the piston recess 328 from a first position (shown in FIG. 3A) to a second position (shown in FIG. 3B) by hydraulic fluid. Hydraulic fluid is routed to one of the hydraulic ports 303 of the housing 301, through the corresponding hydraulic port 329 of the retaining sleeve 322, and into the piston recess 328 at a first end 330. The pressure of the hydraulic fluid on an end of the piston 323 urges the piston 323 towards a second end 331 of the piston recess 328 and the second position. In embodiments including two hydraulic ports 303 in the housing 301 and two hydraulic ports 329 in the retaining sleeve 322, hydraulic fluid may be routed to the second end 331 of the piston recess 328 to urge the piston 323 back towards the first end 330 and the first position.

FIG. 3A illustrates the retrievable module 350 coupled to the housing 301 of the wellhead module 300 and the gate valve 340 with the locking mechanism 320 in the locked state. In the locked state, the locking member 321 is engaged with the recess 302 of the housing 301 to axially fix the actuator assembly 310 within the housing 301.

Further, in the locked state, the piston 323 is in the first position within the piston recess 328. In the first position, the second outer surface 325 of the piston 323 is engaged with the locking member 321 positioning the locking member 321 in a radially extended position thereby retaining the locking member 321 in the recess 302 of the housing 301.

FIG. 3B illustrates the override module 370 coupled to the housing 301 of the wellhead module 300 and the gate valve 340 with the locking mechanism 320 in the unlocked state and the actuator assembly 310 axially translated.

In the unlocked state, the locking member 321 is disengaged with the recess 302 of the housing 301 thereby allowing the actuator assembly 310 to axially move within the housing 301.

In the unlocked state, the piston 323 is in the second position within the piston recess 328. In the second position, the first outer surface 324 of the piston is engaged with the locking member 321 positioning the locking member 321 in a radially retracted position, thereby disengaging the locking member 321 from the recess 302 of the housing 301.

As stated previously, in order to move the piston 323 from the first position to the second position (e.g. configuring the locking mechanism in the unlocked state from the locked state), hydraulic fluid is routed to the first end 330 of the piston recess 328. The hydraulic fluid urges the piston 323 towards the second end 331 of the piston recess 328. As the piston 323 is moved, the locking member 321 is axially retained by the retaining sleeve 322. Therefore, the piston 323 slides underneath the locking member 321 and the locking member 321 is guided along the second outer surface 325 in the radially extended position, down the taper 326 onto the first outer surface 324 and into the radially retracted position. In some embodiments, the radially retracted position is the relaxed (e.g. natural) state of the locking member 321. In some embodiments, the locking member 321 is otherwise biased into the radially retracted position.

In some embodiments, the locking mechanism 320 may be returned to the locked state by simply routing hydraulic fluid to the second end 331 and reversing the above operation.

With the locking mechanism 320 is in the unlocked state, the override module 370 may be used to axially translate the actuator assembly 310 to move the valve member 342 into the open or closed position. FIG. 3B illustrates the actuator assembly 310 translated to move the valve member 342 into the open position.

FIGS. 4A-4B illustrate another exemplary wellhead module 400 and gate valve 440 which may be used in place of wellhead module 106 and gate valve 107 of FIG. 1. Similar to the embodiment shown in FIGS. 4A-4B, the wellhead module 400 includes a housing 401, an actuator assembly 410, and a locking mechanism 420. For the sake of brevity, all similar components have been given reference numbers with the same last two digits, and a full description of such similar components may not be repeated herein.

The housing 401 of the wellhead module 400 includes one or more recesses 402 disposed in an inner surface of the housing 401. Similarly, the actuator assembly 410 includes one or more corresponding recesses 412 disposed in an outer surface of the actuator assembly 410 aligned with the one or more recesses 402 of the housing 401 of the wellhead module 400. The locking mechanism 420 is disposed between the actuator assembly 410 and the housing 401 and includes one or more shearable members 432 (such as shear pins) disposed in the one or more recesses 402 of the housing 401 and disposed in the one or more recesses 412 of the actuator assembly. The one or more shearable members 432 selectively couple the actuator assembly 410 to the housing 401 of the wellhead module 400. In the locked state (as shown in FIG. 4A), the one or more shearable members 432 couple the actuator assembly 410 to the housing 401 such that the actuator assembly 410 is axially fixed within the housing 401. In the unlocked state (as shown in FIG. 4B), the shearable members 432 are sheared thereby allowing the actuator assembly 410 to move axially within the housing 401.

In some embodiments, the housing 401 does not include one or more recesses 402 and the one or more shearable members 432 are rigidly coupled to, and protruding from, the inner surface of the housing 401. In some embodiments, the actuator assembly 410 does not include the one or more recesses 412 and the one or more shearable members 432 are rigidly coupled to, and protruding from the outer surface of the actuator assembly 410.

FIG. 4A illustrates the retrievable module 450 coupled to the housing 401 of the wellhead module 400 and the gate valve 440 with the locking mechanism 420 in the locked state. In the locked state, the shearable members 432 are unsheared and are engaged, and coupled to, both the actuator assembly 410 and the housing 401 to axially fix the actuator assembly 410 within the interior of the housing 401.

FIG. 4B illustrates the override module 470 coupled to the housing 401 of the wellhead module 400 and the gate valve 440 with the locking mechanism 420 in the unlocked state and the actuator assembly 410 axially translated. In the unlocked state, the one or more shearable members 432 are sheared thereby allowing the actuator assembly 410 to axially move within the housing 401.

Configuring the locking mechanism 420 in the unlocked state includes shearing the one or more shearable members 432. In some embodiments, shearing the one or more shearable members 432 includes using the override module 470 to exert an axial force onto the actuator assembly 410 sufficient to shear the one or more shearable members 432. The override module 470 may also be used to axially translate the actuator assembly 410 to move the valve member 442 into the open or closed position. FIG. 4B illustrates the actuator assembly 410 translated to move the valve member 442 into the open position.

Any one or more components of the wellhead modules 200, 300, 400, gate valves 240, 340, 440, retrievable modules 250, 350, 450, and override modules 270, 370, 470 may be integrally formed together, directly coupled together, and/or indirectly coupled together and are not limited to the specific arrangement of components illustrated in FIGS. 1-4B. Any one or more of the embodiments of the wellhead modules 200, 300, 400, gate valves 240, 340, 440, retrievable modules 250, 350, 450, and override modules 270, 370, 470 may be combined in whole or part with any one or more of the embodiments of the wellhead modules 200, 300, 400, gate valves 240, 340, 440, retrievable modules 250, 350, 450, and override modules 270, 370, 470. Further, any one or more of the operations, sub-operations, and steps of the operations described herein may be automated by, for example, one or more controllers of the wellhead system 100, remote to the wellhead system 100, or may be controlled by an operator.

EXAMPLE ASPECTS

Aspect 1: A wellhead module, comprising: a housing, a valve member, an actuator assembly, and a locking mechanism. The valve member extends through an opening at an end of the housing and is translatable between an open position and a closed position. The actuator assembly is disposed within the housing and is configured to translate the valve member between the open position and the closed position. The locking mechanism is convertible from a first state to a second state, the actuator assembly is axially locked to the housing at a first axial position in the first state, and the actuator assembly is unlocked from the housing in a second state and thus movable to a second axial position within the housing.

Aspect 2: The wellhead module of Aspect 1, wherein the actuator assembly translates the valve member between the open position and the closed position by converting rotational motion to translational motion.

Aspect 3: The wellhead module of any of Aspects 1-2, wherein the locking mechanism comprises at least one shearable member, wherein the at least one shearable member axially locks the actuator assembly to the housing in the first state, and wherein the at least one shearable member is sheared in the second state.

Aspect 4: The wellhead module of any of Aspects 1-2, wherein the locking mechanism comprises at least one dog movable from a radially retracted position to a radially extended position, and wherein the at least one dog is in the radially retracted position in the first state, and wherein the at least one dog is in the radially extended position in the second state.

Aspect 5: The wellhead module of any of Aspects 1-2, wherein the locking mechanism comprises a snap ring movable between a radially extended position and a radially retracted position, wherein the snap ring is in the radially extended position in the first state, and wherein the snap ring is in the radially retracted position in the second state.

Aspect 6: The wellhead module of any of Aspects 1-2, wherein the locking mechanism comprises a locking member and a piston. The locking member movable between a radially retracted position and a radially extended position. The locking member is engaged with the housing in the radially extended position in the first state to axially lock the actuator assembly to the housing. The locking member is disengaged from the housing when in the radially retracted position in the second state to unlock the actuator assembly from the housing. The piston is movable from a first position to a second position. The piston is in the first position and retains the locking member in the radially extended position in the first state. The piston is in the second position and the locking member is allowed to move to the radially retracted position in the second state.

Aspect 7: The wellhead module of any of Aspects 1-6, wherein the housing is coupled to a retrievable module, and wherein the retrievable module is configured to actuate the actuator assembly to translate the valve member between the open position and the closed position.

Aspect 8: The wellhead module of any of Aspects 1-6, wherein the housing is coupled to an override module, and wherein the override module is configured to move the actuator assembly from the first axial position to the second axial position within the housing.

Aspect 9: The wellhead module of any of Aspects 1-8, wherein when the actuator assembly is in the first axial position, the valve member is in the closed position and when the actuator assembly is moved to the second axial position, the valve member is moved to the open position.

Aspect 10: A wellhead module, comprising: a housing, a valve member, an actuator assembly, at least one locking member, and a piston. The valve member extends through an opening at an end of the housing and is translatable between an open position and a closed position. The actuator assembly is disposed within the housing and is configured to translate the valve member between the open position and the closed position. The at least one locking member is movable from a radially extended position to a radially retracted position, the actuator assembly is axially fixed to the housing at a first axial position when the at least one locking member is in the radially extended position and the actuator assembly is movable to a second axial position relative to the housing when the at least one locking member is in the radially retracted position. The piston is disposed in the housing movable from a first position to a second position, wherein in the first position the piston retains the locking member in the radially extended position, and wherein the at least one locking member is allowed to move to the radially retracted position when the piston is moved to the second position.

Aspect 11: The wellhead module of Aspect 10, wherein the actuator assembly translates the valve member between the open position and the closed position by converting rotational motion to translational motion.

Aspect 12: The wellhead module of any of Aspects 10-11, further comprising a hydraulic system configured to move the piston between the first position and the second position.

Aspect 13: The wellhead module of any of Aspects 10-12, wherein the locking member is a snap ring, and wherein in the radially extended position the locking member is retained in a groove disposed in an inner surface of the housing.

Aspect 14: The wellhead module of any of Aspects 10-13, wherein when the actuator assembly is in the first axial position, the valve member is in the closed position and when the actuator assembly is moved to the second axial position, the valve member is moved to the open position.

Aspect 15: The wellhead module of any of Aspects 10-14, wherein the housing is coupled to a retrievable module, and wherein the retrievable module is configured to actuate the actuator assembly to translate the valve member between the open position and the closed position.

Aspect 16: The wellhead module of any of Aspects 10-14, wherein the housing is coupled to an override module, and wherein the override module is configured to move the actuator assembly from the first axial position to the second axial position within the housing.

Aspect 17: A method for overriding a gate valve, comprising: engaging an override module with a module coupled to a valve member, wherein the module includes a housing and an actuator assembly locked to the housing in a first axial position and connected to the valve member; unlocking the actuator assembly from the housing; and actuating the override module to move the actuator assembly from the first axial position to a second axial position within the housing to move the valve member from a first position to a second position.

Aspect 18: The method of Aspect 17, wherein unlocking the actuator assembly from the housing comprises shearing one or more shearable members selectively coupling the actuator assembly to the housing.

Aspect 19: The method of Aspect 17, wherein unlocking the actuator assembly comprises moving a locking member selectively coupling the actuator assembly to the housing from a radially extended position to a radially retracted position.

Aspect 20: The method of Aspect 19, wherein moving the locking member from the radially extended position to the radially retracted position comprises moving a piston from a first position to a second position, wherein in the first position, the piston retains the locking member in a recess disposed in an inner surface of the housing.

It is contemplated that any one or more elements or features of any one disclosed embodiment or example may be beneficially incorporated in any one or more other non-mutually exclusive embodiments or examples. While the foregoing is directed to embodiments of the present disclosure, other and further embodiments of the disclosure may be devised without departing from the basic scope thereof, and the scope thereof is determined by the claims that follow.

The following claims are not intended to be limited to the aspects shown herein, but are to be accorded the full scope consistent with the language of the claims. Within a claim, reference to an element in the singular is not intended to mean "one and only one" unless specifically so stated, but rather "one or more." Unless specifically stated otherwise, the term "some" refers to one or more. No claim element is to be construed under the provisions of 35 U.S.C. § 112(f) unless the element is expressly recited using the phrase "means for." All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. A wellhead module, comprising:

a housing;

a valve member, wherein the valve member extends through an opening at an end of the housing, and wherein the valve member is translatable between an open position and a closed position;

an actuator assembly disposed within the housing and configured to axially translate the valve member relative to the actuator assembly and between the open position and the closed position; and a locking mechanism convertible from a first state to a second state via radial movement of a portion of the locking mechanism away from the housing, the actuator assembly being axially locked to the housing at a first axial position when the locking mechanism is in the first state, the actuator assembly being unlocked from the housing when the locking mechanism is in the second state and thus movable to a second axial position within the housing.

2. The wellhead module of claim 1, wherein the actuator assembly translates the valve member between the open position and the closed position by converting rotational motion to translational motion.

3. The wellhead module of claim 1, wherein the locking mechanism comprises at least one dog movable from a radially retracted position to a radially extended position, and wherein the at least one dog is in the radially retracted position in the first state, and wherein the at least one dog is in the radially extended position in the second state.

4. The wellhead module of claim 1, wherein the locking mechanism comprises a snap ring movable between a radially extended position and a radially retracted position, wherein the snap ring is in the radially extended position in the first state, and wherein the snap ring is in the radially retracted position in the second state.

5. The wellhead module of claim 1, wherein the locking mechanism comprises:

a locking member movable between a radially retracted position and a radially extended position, wherein:

the locking member is engaged with the housing in the radially extended position in the first state to axially lock the actuator assembly to the housing; and the locking member is disengaged from the housing when in the radially retracted position in the second state to unlock the actuator assembly from the housing; and a piston movable from a first position to a second position, wherein:

the piston is in the first position and retains the locking member in the radially extended position in the first state; and the piston is in the second position and the locking member is allowed to move to the radially retracted position in the second state.

6. The wellhead module of claim 1, wherein the housing is coupled to a retrievable module, and wherein the retrievable module is configured to actuate the actuator assembly to translate the valve member between the open position and the closed position.

7. The wellhead module of claim 1, wherein the housing is coupled to an override module, and wherein the override module is configured to move the actuator assembly from the first axial position to the second axial position within the housing.

8. The wellhead module of claim 1, wherein:

when the actuator assembly is in the first axial position, the valve member is in the closed position; and when the actuator assembly is moved to the second axial position, the valve member is moved to the open position.

9. A wellhead module, comprising:

a housing;

a valve member, wherein the valve member extends through an opening at an end of the housing, and wherein the valve member is translatable between an open position and a closed position;

an actuator assembly disposed within the housing and configured to axially translate the valve member relative to the actuator assembly and between the open position and the closed position;

at least one locking member movable away from the housing from a radially extended position to a radially retracted position, wherein the actuator assembly is axially fixed to the housing at a first axial position when the at least one locking member is in the radially extended position, and wherein the actuator assembly is movable to a second axial position relative to the housing when the at least one locking member is in the radially retracted position; and a piston disposed in the housing movable from a first position to a second position, wherein in the first position the piston retains the at least one locking member in the radially extended position, and wherein the at least one locking member is allowed to move to the radially retracted position when the piston is moved to the second position.

10. The wellhead module of claim 9, wherein the actuator assembly translates the valve member between the open position and the closed position by converting rotational motion to translational motion.

11. The wellhead module of claim 9, further comprising a hydraulic system configured to move the piston between the first position and the second position.

12. The wellhead module of claim 9, wherein the at least one locking member is a snap ring, and wherein in the radially extended position, the at least one locking member is retained in a groove disposed in an inner surface of the housing.

13. The wellhead module of claim 9, wherein:

when the actuator assembly is in the first axial position, the valve member is in the closed position; and when the actuator assembly is moved to the second axial position, the valve member is moved to the open position.

14. The wellhead module of claim 9, wherein the housing is coupled to a retrievable module, and wherein the retrievable module is configured to actuate the actuator assembly to translate the valve member between the open position and the closed position.

15. The wellhead module of claim 9, wherein the housing is coupled to an override module, and wherein the override module is configured to move the actuator assembly from the first axial position to the second axial position within the housing.

* * * * *